United States Patent [19]

Dallas

[11] Patent Number: 4,952,067

[45] Date of Patent: Aug. 28, 1990

[54] HOMOGENIZING APPARATUS

[76] Inventor: Tolbert H. Dallas, Rte. 1, Box 357, Fulton, Ky. 42041

[21] Appl. No.: 434,313

[22] Filed: Nov. 13, 1989

[51] Int. Cl.[5] ..... B01F 5/06

[52] U.S. Cl. ..... 366/337; 99/452; 251/63.6; 366/176; 366/340

[58] Field of Search ..... 366/336, 340, 337, 341, 366/176; 99/452, 453, 460; 251/63.5, 63.6

[56] References Cited

U.S. PATENT DOCUMENTS

| | | | |
|---|---|---|---|
| 2,882,025 | 4/1959 | Loo | 366/340 |
| 4,383,769 | 5/1983 | Pandolfe | 366/337 |
| 4,585,357 | 4/1986 | Ogata | 366/340 |
| 4,869,849 | 9/1989 | Hirose | 366/340 |

*Primary Examiner*—Robert W. Jenkins

*Attorney, Agent, or Firm*—Brady, O'Boyle & Gates

[57] ABSTRACT

Homogenizing apparatus having a stack of disc valves made of stainless steel having a Brinell hardness from 40–42. A hydraulic actuator for applying a force to the stack of disc valves is spaced above the valve disc housing, the space therebetween being vented to the atmosphere to prevent hydraulic leakage into the valve housing. The disc valves are maintained in stacked relationship by stainless steel rods having their lower ends welded to a bottom plate supporting the stack of valve discs. To enhance the washing and cleaning of the apparatus radii are provided on all of the corners of the fluid contacting components which have angles less than 135°.

12 Claims, 4 Drawing Sheets

FIG. 6
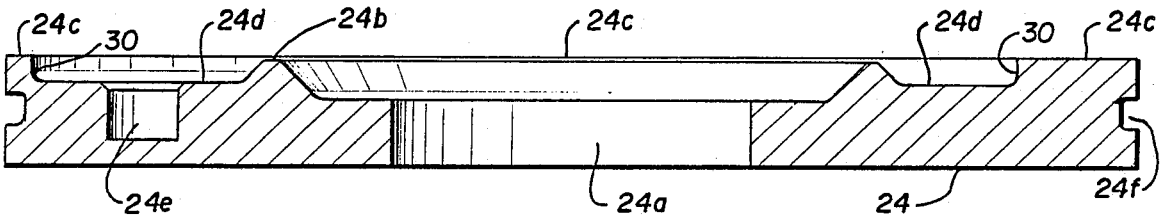
FIG. 7
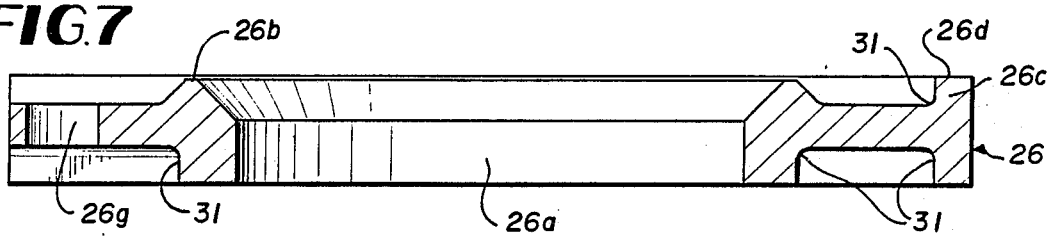
FIG. 8
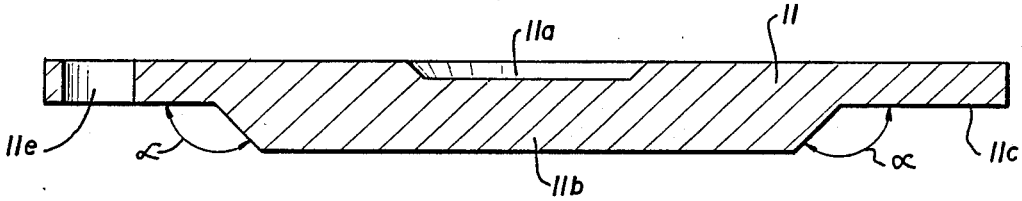
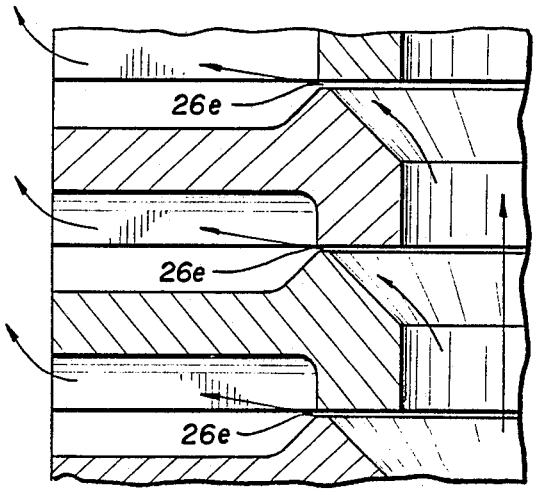
FIG. 9
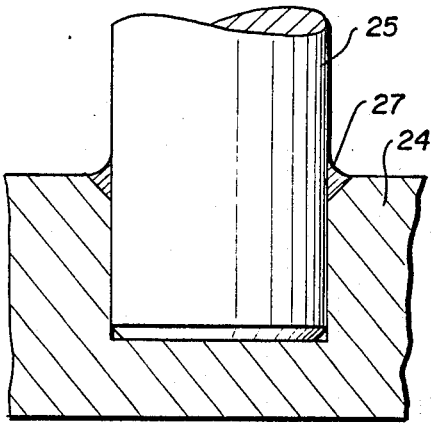
FIG. 10

HOMOGENIZING APPARATUS

BACKGROUND OF THE INVENTION

Homogenizing apparatus of the type disclosed in U.S. Pat. Nos. 2,882,025 and 4,383,769 are employed in the dairy industry to break down and disperse milk fat globules. These homogenizers include a stacked configuration of valve members each of which has an annular knife edge valve seat spaced from an opposing valve surface, to thereby form a narrow gap or slot, through which the milk to be homogenized is forced, whereby the emulsion undergoes extremely rapid acceleration as well as an extreme drop in pressure. The cavitation and turbulence through the valve members breaks down the milk fat globules within the emulsion to produce the homogenized milk. The size of the gap can be varied by a hydraulic actuator acting on the valve stack.

While these known homogenizers have been satisfactory for their intended purpose, they have been characterized by certain disadvantages. For instance, the material from which the valve members have been made is of a hard metal which resists flexing of the valve members during operation, resulting in a cracking of the valve members. Furthermore, the constructural configuration of the valve members included holes formed therein for the flow of the homogenized milk after it had passed through the valve slot or gap. These holes in the valve members further weakened the valve members which contributed to the cracking of the valve members.

Furthermore, the U.S. Food and Drug Administration has set certain standards with regard to the construction and arrangement of milk homogenizers to prevent contamination of the milk during the homogenizing process and to facilitate the washing and cleaning of the homogenizers. For instance, the hydraulic valve actuator has to be spaced from the stacked valve housing so that any hydraulic leakage will flow outside the valve housing to prevent contamination of the milk.

To facilitate washing, all milk contacting surfaces which have angles less than 135° must have a radii in the corner of the angle. Also, there can be no threaded connections within the stacked disc valve housing because threads provide crevices which are very difficult to clean.

To overcome the disadvantages experienced in the prior art homogenizers, the homogenizer of the present invention has been devised and comprises, essentially, a stack of disc valves each of which is made of stainless steel having a Brinell hardness from 40 to 42, and having an annular knife edge spaced from an opposing valve disc, to thereby form a narrow gap or slot, through which the milk to be homogenized is forced.

The stack of disc valves are supported on a bottom plate having stainless steel guide rods welded thereto. The guide rods extend upwardly through the stack of valve discs and through a top plate positioned on the top of the stack of disc valves.

A push rod engages the top plate and is detachably connected to the piston rod of a hydraulic cylinder spaced above the stacked valve housing, the space between the valve housing and hydraulic cylinder communicating with the atmosphere, whereby any leakage from the hydraulic cylinder will not contaminate the milk within the valve housing.

BRIEF DESCRIPTION OF THE DRAWINGS

FIG. 6 is a view taken along line 6—6 of FIG. 3:

FIG. 7 is a view taken along line 7—7 of FIG. 4:

FIG. 8 is a view taken along line 8—8 of FIG. 5:

FIG. 9 is an enlarged, fragmentary, sectional, side elevational view of the stacked valve discs illustrating the direction of flow of the milk through the stack; and FIG. 10 is an enlarged, fragmentary, partly in section, side elevational view of the lower end of one of the valve disc guide rods welded to the bottom support plate.

DESCRIPTION OF THE PREFERRED EMBODIMENT

Figure 1:
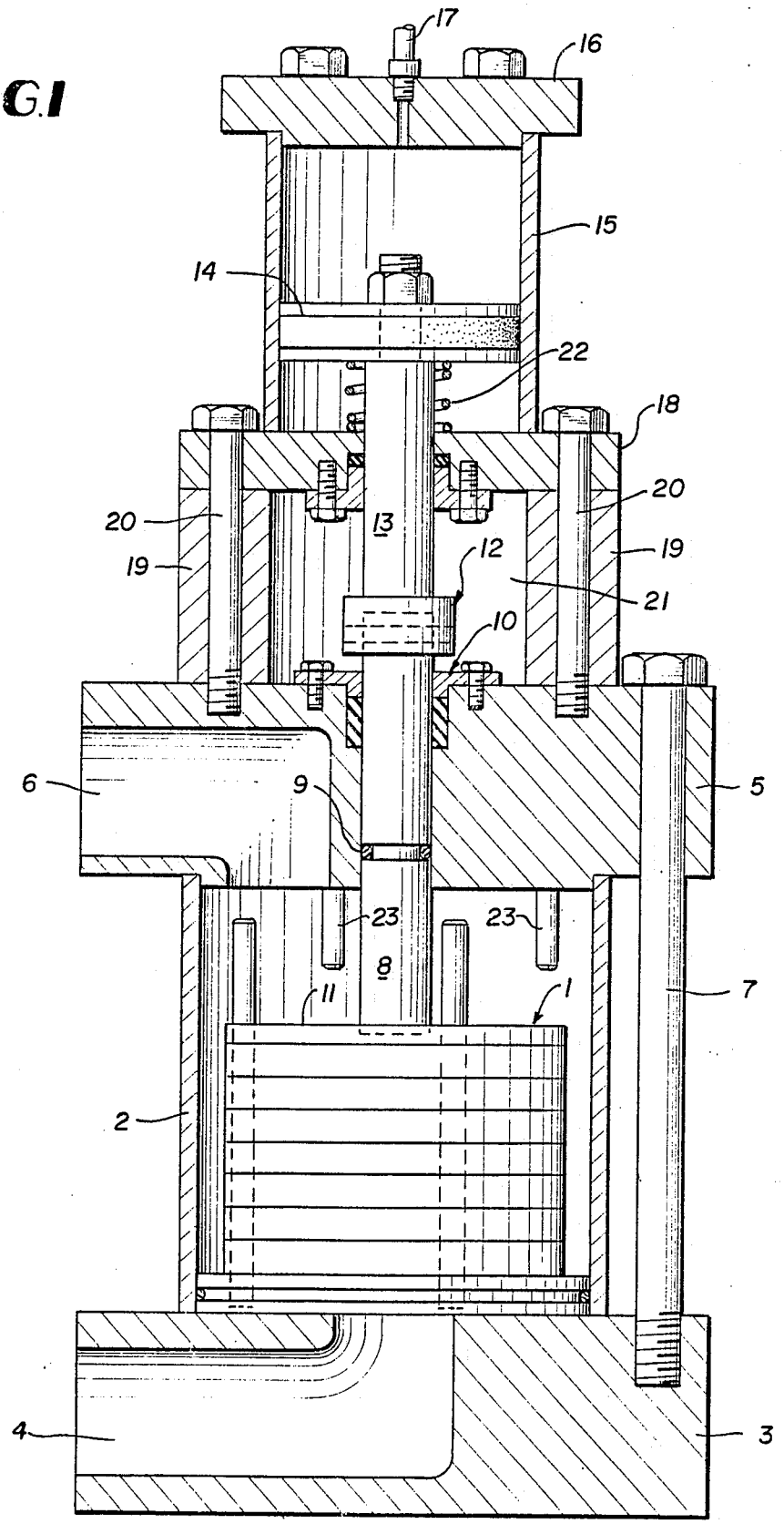
FIG. 1 is a side elevational view, partly in section, of the homogenizing apparatus of the present invention.

Referring to the drawings, and more particularly to FIG. 1, the homogenizing apparatus of the present invention comprises a stack of valve discs 1 mounted within a housing 2, having a lower end wall 3 provided with an inlet 4 through which the milk to be homogenized flows into the valve stack 1. The housing 2 is provided with an upper end wall 5 having an outlet 6 through which the homogenized milk flows, the ends walls 3 and 5 being held in sealing engagement against the ends of the housing 2 by tie bolts 7.

A push rod 8 extends through the upper end wall 5 and is slidably mounted, and in sealing engagement therein by an O-ring 9 and a bushing assembly 10. The lower end of the push rod 8 engages a top plate 11 of the stack 1, and the upper end of the push rod is detachably connected by a suitable coupling 12 to the end of a piston rod 13 connected to a piston 14 slidably mounted within a hydraulic cylinder 15. The cylinder 15 is provided with an upper end wall 16, having a hydraulic fluid inlet 17, and a lower end wall 18 spaced above the upper end wall 5 of the valve housing 2. The hydraulic cylinder is held in spaced relationship above the valve housing 2 by sleeve members 19 extending between the lower end wall 18 of the hydraulic cylinder 15 and the upper end wall 5 of the valve housing 2, the hydraulic cylinder 15 being rigidly connected to the upper end wall 5 of the valve housing by bolts 20 extending through the sleeves 19 and threaded into the upper end wall 5 of the valve housing 2. The space 21 between lower end wall 18 of the hydraulic cylinder 15 and the upper end wall 5 of the valve housing 2 is open to the atmosphere so that any leakage from the hydraulic cylinder 15 will not flow through the valve housing end wall 5 to contaminate the milk therein.

A coil spring 22 is mounted between the cylinder end wall 18 and the piston 14 for biasing the piston rod 13 and associated push rod 8 upwardly when the hydraulic pressure is reduced in the hydraulic cylinder 15.

A plurality of depending rods 23 are integrally connected to the bottom surface of the valve housing end wall 5 for limiting the upward movement of the valve stack 1, when the push rod 8 has been moved upwardly away from the top plate 11.

Figure 2:
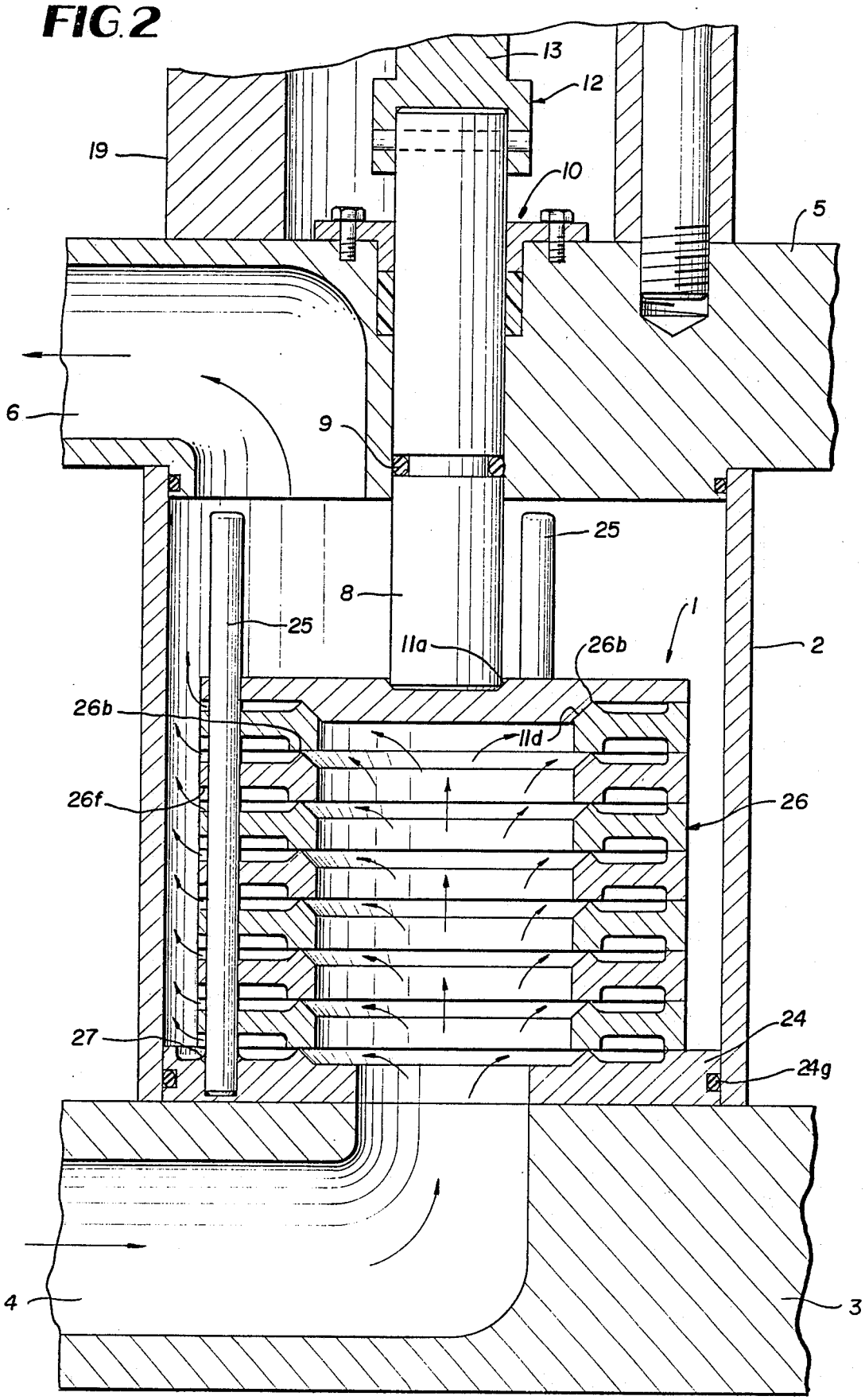
FIG. 2 is an enlarged, fragmentary, sectional, side elevational view of the stacked disc valves within the valve housing.

As will be seen in FIG. 2, the valve stack 1 includes a bottom support plate 24 supported on the top surface of the valve housing bottom wall 3. A plurality of vertically extending stainless steel guide rods 25 are provided upon which the top plate 11 and plurality of stacked valve discs 26 are slidably mounted, the lower ends of the guide rods 25 being welded to the support plate as at 27.

Figure 3:
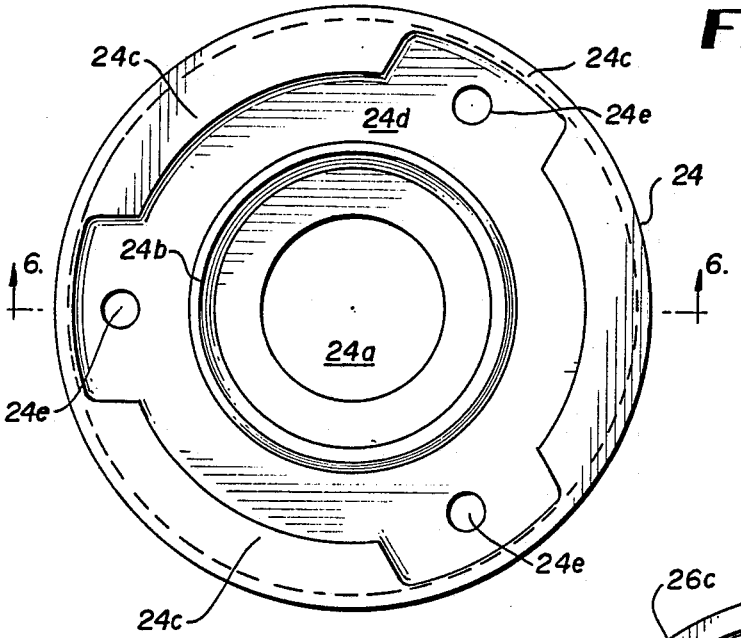
FIG. 3 is a top plan view of the bottom support plate for the valve stack.

The details of the construction of the bottom or base support plate 24 are shown in FIGS. 3 and 6, wherein it will be seen that the support plate 24 is configured as a circular disc having a central opening 24*a* provided therein and an upwardly, axially extending knife edge 24*b* positioned radially outwardly from the central opening 24*a*. The base plate 24 is provided with a peripheral upper wall portion 24*c* which extends slightly above the horizontal plane containing the knife edge 24*b*, to thereby provide an annular recess 24*d* between the peripheral wall portion 24*c* and the knife edge 24*b*. A plurality of circumferentially spaced circular recesses 24*e* are formed in annular recess 24*d* for receiving the lower ends of the guide rods 25, as shown in FIG. 2. The bottom surface of the base plate 24 is planar and the side wall is provided with an annular groove 24*f* for receiving an O-ring 24*g*, as shown in FIG. 2.

Figure 4:
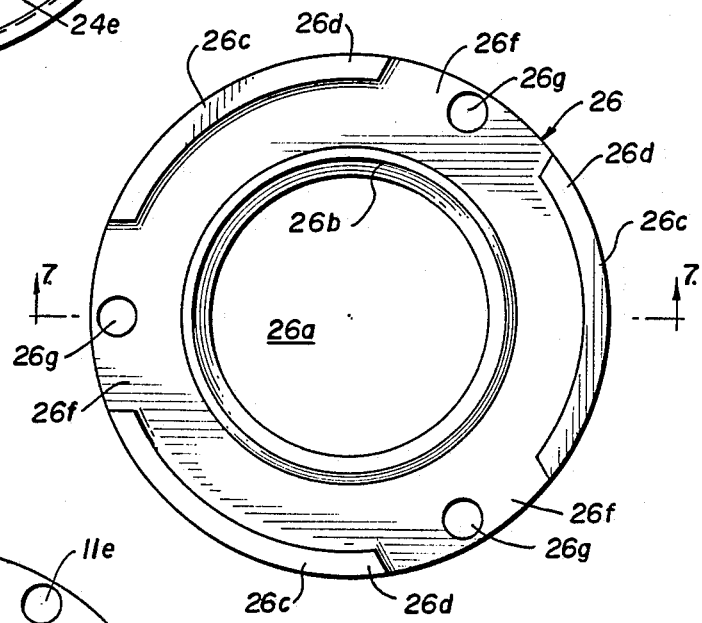
FIG. 4 is a top plan view of one of the valve discs.

As will be seen in FIGS. 4 and 7, each valve disc 26, made of stainless steel having a Brinell hardness from 40 to 42, has a central opening 26*a* and an upwardly, axially extending knife edge 26*b* positioned radially outwardly from the central opening 26*a*. The peripheral surface of each valve disc is provided with a plurality of circumferentially spaced, axially extending flange portions 26*c*. The upper wall surfaces 26*d* of the flange portions 26*c* extend slightly above the horizontal plane containing the knife edge 26*b* so that when the valve discs are stacked as shown in FIGS. 2 and 9, a slight clearance or slot 26*e* is provided between the knife edge of one valve disc and the bottom surface of the next adjacent valve disc. The spaces 26*f* between the flange portions 26*c* communicate with the slots 26*e* to facilitate the flow of homogenized milk through the housing. Each space 26*f* is provided with an aperture 26*g* through which the guide rods 25 extend for maintaining the stacked valve discs in alignment.

Figure 5:
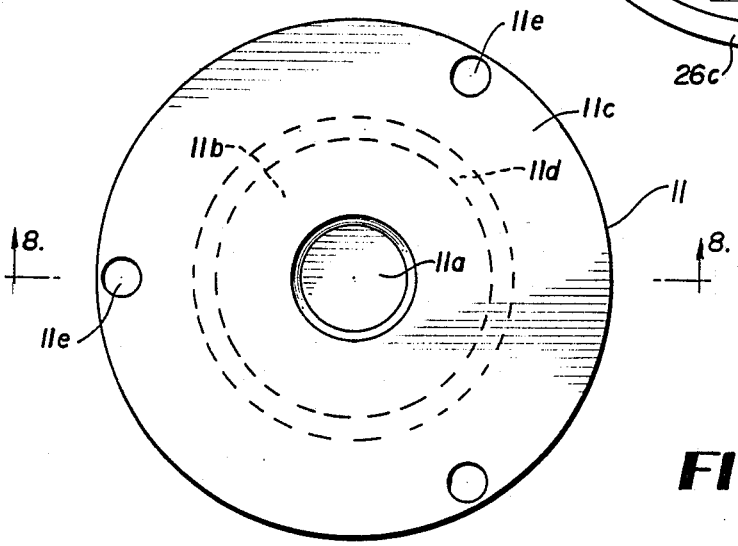
FIG. 5 is a top plan view of the top plate employed in the stack of valve discs.

Referring to FIGS. 5 and 8, the top plate 11 is configured as a disc having a centrally disposed recess 11*a* provided in the upper surface thereof for receiving the lower end of the push rod 8. The bottom surface of the top plate is provided with a relatively thick surface area 11*b* and a relatively thin peripheral surface area 11*c*. A tapered wall 11*d* extends between the surface areas 11*b* and 11*c*, the included angle $\alpha$ between the wall 11*d* and surface area 11*c* being approximately 135° for accommodating the knife edge 26*b* of the valve disc on the top of the stack as shown in FIG. 2. By this construction and arrangement, the top plate 11 not only distributes the biasing force of the hydraulic cylinder to the valve stack, but also, because of the cooperating arrangement between the bottom surface of the top plate and the knife edge of the topmost valve disc, the top plate can add to the homogenizing action of the stack. A plurality of axially extending apertures 11*e* are also provided in the top plate and are adapted to be aligned with the apertures 26*g* in the stack of valve disc through which the guide rods 25 extend.

When in the stacked arrangement as shown in FIG. 2, an axially extending central passage 28 is formed in the stack which communicates between the milk inlet 4 and the valve disc slots 26*e*. An annular passage 29 is formed between the valve housing 2 and the outer peripheral surface of the stack, whereby the homogenized milk flows from the slots 26*e* to the outlet 6.

A feature of the homogenizing apparatus of the present invention to enhance the washing and cleaning thereof includes providing radii in all of the corners of the milk contacting components which have angles less than 135°. For instance, the corners in the upper surface of the bottom plate 24 are provided with radii as at 30, as shown in FIG. 6, and the valve discs are provided with radii as at 31.

By welding the guide rods 25 to the bottom plate 24 as at 27 as shown in FIG. 10, rather than threadably connecting the rods to the bottom plates, facilitates the washing of the apparatus since there are no crevices for the milk to flow into.

From the above description, it will be readily apparent to those skilled in the art that the construction and arrangement of the homogenizing apparatus of the present invention provides an apparatus that is more easily washed than heretofore since there are no threaded connections or 90° corners in the milk flow path. By having the space 21 between the hydraulic cylinder 15 and valve housing communicating with the atmosphere, hydraulic fluid cannot leak into the valve housing to contaminate the milk, and by making the valve discs of stainless steel having a Brinell hardness from 40 to 42, and without any additional axial apertures through which the milk could flow, the valve discs can flex during the homogenizing process and not crack as heretofore.

Furthermore, during the operation of the homogenizing apparatus, there is a very small amount of wear on the upper surfaces 26*d* of the disc flange portions 26*c*, whereby the homogenizing gaps 26*e* are maintained in a working position much longer than they would if the discs were made of a harder Brinell metal.

It is to be understood that the form of the invention herewith shown and described is to be taken as a preferred example of the same, and that various changes in the shape, size and arrangement of parts may be resorted to, without departing from the spirit of the invention or scope of the subjoined claims.

I claim:

1. In a homogenizing apparatus of the type including a stacked configuration of valve disc members mounted within a housing and a hydraulic actuator operatively connected to the stack of valve discs for applying a downwardly biasing force on the stack of valve discs, the improvement comprising, the hydraulic actuator being spaced above the valve disc housing, the space between the hydraulic actuator and valve housing communicating with the atmosphere, whereby hydraulic fluid leakage from the hydraulic actuator will flow to the atmosphere, to thereby prevent the fluid being homogenized within the valve housing from becoming contaminated.

2. In a homogenizing apparatus of the type including a stacked configuration of valve disc members mounted within a housing and an actuator operatively connected to the stack of valve discs for applying a downwardly biasing force on the stack of valve discs, the improvement comprising a base plate for said stack of valve discs, said base plate being configured as a circular disc, a central opening provided in said base plate, an upwardly, axially extending annular knife edge provided on the upper surface of said base plate and positioned radially outwardly from said central opening, a peripheral upper wall portion on the base plate, said peripheral wall portion extending slightly above the horizontal plane containing said knife edge, an annular recess formed in the upper surface of said base plate between the peripheral wall portion and the knife edge, a plurality of circumferentially spaced recesses formed in said annular recess, and a plurality of guide rods, each guide rod having one end mounted within a respective recess and extending axially therefrom.

3. In a homogenizing apparatus according to claim 2, wherein the ends of the guide rods are welded into the recesses.

4. In a homogenizing apparatus according to claim 2, wherein each valve disc member comprises a disc, a central opening provided in said disc, an upwardly, axially extending annular knife edge provided on the upper surface of said disc positioned radially outwardly from the central opening, a plurality of circumferentially spaced, axially extending flange portions provided on the peripheral surface of said disc, the upper wall surfaces of said flange portions extending slightly above the horizontal plane containing said knife edge, whereby when the valve discs are stacked a slot is provided between the knife edge of one valve disc and the bottom surface of the next adjacent valve disc, the spaces between said flange portions communicating with said slot to facilitate the flow of fluid through the valve stack.

5. In a homogenizing apparatus according to claim 4, wherein each valve disc is made of stainless steel having a Brinell hardness from 40 to 42.

6. In a homogenizing apparatus according to claim 4, wherein an aperture is provided in each space between said flange portions, and a guide rod extends through said aperture.

7. In a homogenizing apparatus according to claim 4, wherein a top plate is mounted on the uppermost valve disc of said stack, said top plate comprising a disc, a centrally disposed recess provided in the upper surface of said top plate for receiving the end of said actuator, the bottom surface of the top plate having a relatively thick centrally disposed surface area, and a relatively thin peripheral surface area, a tapered wall extending between said surface areas, the included angle between the tapered wall and peripheral surface being configured to accommodate the knife edge of the uppermost valve disc of said stack.

8. In a homogenizing apparatus according to claim 7, wherein a plurality of apertures are provided in the peripheral surface area of said top plate and aligned with the guide rod receiving apertures in said valve discs, said guide rods extending through the top plate apertures.

9. In a homogenizing apparatus according to claim 7, wherein the valve housing includes an end wall spaced above the top plate, and a plurality of depending rods integrally connected to said end wall for limiting the upward movement of the valve stack when the end of the actuator has been moved upwardly away from the top plate.

10. In a homogenizing apparatus according to claim 4, wherein on all the fluid contacting corners of the base plate and valve discs which have angles less than 135° a radius is provided.

11. A valve disc for use in a homogenizing apparatus of the type having a stacked configuration of valve discs, comprising a disc, a central opening provided in said disc, an upwardly, axially extending annular knife edge provided on the upper surface of said disc positioned radially outwardly from the central opening, a plurality of circumferentially spaced, axially extending arcuate flange portions provided on the peripheral surface of said disc, the upper wall surfaces of said flange portions extending slightly above the horizontal plane containing said knife edge, whereby when the valve discs are stacked, a slot is provided between the knife edge of one disc and the bottom surface of the next adjacent valve disc, the spaces between said flange portions communicating with said slot to facilitate the flow of fluid through the valve stack.

12. A valve disc according to claim 11, wherein the valve disc is made of stainless steel having a Brinell hardness from 40 to 42, whereby the slots are maintained in a working position much longer than they would if made from a harder Brinell metal.

* * * * *